US006210622B1

(12) United States Patent
Reese et al.

(10) Patent No.: US 6,210,622 B1
(45) Date of Patent: Apr. 3, 2001

(54) PROCESS OF MAKING POLYMERIC FIBERS

(75) Inventors: Glen Patrick Reese; James Richard Goodall, both of Charlotte, NC (US)

(73) Assignee: Arteva North America S.A.R.L., Zurich (CH)

( * ) Notice: Subject to any disclaimer, the term of this patent is extended or adjusted under 35 U.S.C. 154(b) by 0 days.

(21) Appl. No.: 09/356,138

(22) Filed: Jul. 19, 1999

(51) Int. Cl.[7] ..... D02G 1/12; D02G 1/14; D02J 1/22; D06M 10/00

(52) U.S. Cl. ..... 264/479; 264/168; 264/235.6; 264/290.5; 264/481

(58) Field of Search ..... 264/168, 210.3, 264/210.4, 210.5, 210.8, 211.17, 235.6, 289.6, 290.5, 290.7, 346, 479, 481, 489, 492

(56) References Cited

U.S. PATENT DOCUMENTS

| | | | | |
|---|---|---|---|---|
| 2,918,346 | | 12/1959 | Paulsen | 264/289.6 X |
| 3,259,681 | | 7/1966 | Bull et al. | 264/210.3 X |
| 3,364,294 | * | 1/1968 | Garibian et al. | 264/479 |
| 3,567,817 | | 3/1971 | Spiller | 264/289.6 |
| 3,816,486 | | 6/1974 | Vail . | |
| 3,894,135 | | 7/1975 | Riggert et al. . | |
| 3,972,127 | | 8/1976 | Hoshi et al. . | |
| 4,105,740 | | 8/1978 | Yasuda et al. . | |
| 4,112,668 | | 9/1978 | Spiller . | |
| 4,704,329 | | 11/1987 | Hancock et al. . | |
| 5,073,322 | * | 12/1991 | Hansen | 264/168 X |
| 5,175,239 | | 12/1992 | Gauntt et al. . | |
| 5,375,310 | | 12/1994 | Greifeneder et al. . | |
| 5,679,300 | * | 10/1997 | Lorenz et al. | 264/168 X |

FOREIGN PATENT DOCUMENTS

| | | |
|---|---|---|
| 423 807 A1 | 4/1991 | (EP) . |
| 493050 | 7/1992 | (EP) . |
| 540062 | 5/1993 | (EP) . |
| 1219154 | 1/1971 | (GB) . |
| 51-32816 | 3/1976 | (JP) . |
| 53-45417 | 4/1978 | (JP) . |
| 63-135516 | 6/1988 | (JP) . |
| 594220 | 2/1978 | (SU) . |
| 958529 | 9/1982 | (SU) . |
| 1700116 A1 | 12/1991 | (SU) . |

OTHER PUBLICATIONS

K.R. Riggert, "The Drawing of Polyester Tow" Chemiefasern/ Textilindstrie, pp. 638–648, —(Sep. 1981).
Fiber Producer, Dec. 1976.

* cited by examiner

*Primary Examiner*—Leo B. Tentoni
(74) *Attorney, Agent, or Firm*—Gregory N. Clements

(57) ABSTRACT

A for the production of polymeric fibers in the form of a tow includes drawing and heat setting, with and without crimping, in which the tow has a constant denier per inch during the processing. The process permits very large drawn tows to be produced having a thickness of at least 150,000 denier per inch of width during processing through the production equipment/apparatus. The production apparatus includes a conventional stacker, followed by drawing apparatus, followed by heat setting apparatus, and optionally followed by crimping apparatus. Positioning the stacker before the drawing apparatus allows very large tows to be produced using drawing and heat setting apparatus having rolls significantly shorter than is conventionally known.

38 Claims, 2 Drawing Sheets

PROCESS OF MAKING POLYMERIC FIBERS

BACKGROUND OF THE INVENTION

1) Field of the Invention

The present invention relates to the production of synthetic polymeric material in filament form for use in fiber manufacture and, more particularly, to apparatus and method for drawing, heat setting, and crimping such filamentary material, particularly polyethylene terephthalate (PET) commonly referred to as polyester. In particular, the present invention relates to a new draw line for tow having an undrawn denier of about 3 million or greater and a drawn tow having a denier of 1.0 million denier or greater. More specifically, the present invention relates to drawing, heat setting and crimping of a polymeric tow, whereby the tow has a constant denier per inch of width after drawing.

2) Prior Art

In the conventional manufacture of synthetic yarns, a molten polymeric material is extruded in the form of multiple continuous filaments which, after quenching to cool the filaments, are gathered and transported longitudinally in a lengthwise co-extensive bundle commonly referred to as a tow. Particularly with polymeric materials such as PET, the tows are subjected to a subsequent drawing and heating operation to orient and heat set the molecular structure of each constituent filament in each tow.

A typical drawing and heat setting operation involves transporting multiple tows in side-by-side relation sequentially through two or more drawstands operating at progressively greater driven speeds to exert a lengthwise stretching force on the tows and their individual filaments while traveling between the drawstands thereby performing a drawing to molecularly orient the individual filaments, followed by a calender structure about which the tow travels peripherally in a sinuous path to be sufficiently heated to set the molecular orientation of the filaments. Normally, the tow is transported through a quench stand to be cooled immediately following the calender structure and finally a number of tows are combined together in a stacker and transported to a crimper, such as a so called stuffer box, to impart texture and bulk to the filaments.

Conventional draw-line-stands spread out the tow in a ribbon-like shape before drawing the filaments of the tow and the flattened tow is not recombined until after quenching and before the crimper. Conventional draw-line-stands employ cantilevered rolls for the drawing operation of the ribbon-like tow, which requires the supporting walls to be very large, and the mechanical bearing structures of the cantilevered rolls to be sufficiently massive to support the rolls and resist the bending moments and deflective forces imposed by tows of the size and denier conventionally being processed.

U.S. Pat. No. 2,918,346 to Paulsen discloses a process for orienting a dense tow of polyester filaments. Paulsen discloses heating the tow band in a heated bath and drawing the tow 2.3 to 5.8 times its original length. In Example 3, Paulsen discloses an undrawn tow having a density of 142,000 denier per inch, corresponding to a drawn density between about 24,000 and 62,000 denier per inch.

U.S. Pat. No. 3,259,681 to Bull et al. schematically illustrates a process for making polyester tow starting from the spinnerette and continuing, through the drawing stages, heat setting, and lastly crimping of the tow. In Example 4 of this patent an undrawn tow of 130,000 denier per inch is disclosed.

U.S. Pat. No. 3,567,817 to Spiller discloses a process for drawing a tow by means of a series of rolls, including hot liquid to heat the tow between draws. In Example 4 of this patent,an undrawn polyester tow of approximately 267,000 denier per inch is disclosed.

While the patents to Paulsen, Bull et al. and Spiller disclose large denier tows, these are undrawn. The present invention produces drawn tows of 150,000 denier/inch or greater.

Tow drawing and heat setting lines of the type described above have proven to be reasonably effective and reliable for the intended purpose. However, as the fiber industry continually strives to improve efficiency and reduce manufacturing costs, much effort has been devoted to attempts to increase the number of filaments in each tow and to increase the lineal speed at which the filaments are processed through the drawing and heat setting line, which presents particular difficulties and problems in construction of the apparatus within the line and in effectively accomplishing heat setting of all of the constituent filaments in a tow.

SUMMARY OF THE INVENTION

The present invention seeks to overcome the massive construction of the conventional draw-line-stand by employing massive undrawn tows of 3 million denier or larger. Unlike conventional draw-lines which use a stacker after quenching to combine several tows, the present invention stacks or combines several tows before the drawing stage such that the massive tow travels through the entire draw-line to the crimper. By avoiding a conventional draw-line, which spreads a tow into a ribbon like shape, the massive tow is formed into a flattened shape, but it is not ribbon-thin. Instead it is thick like a very thick belt and has 150,000 denier/inch or greater as it traverses the drawstand, heat setting apparatus, and the crimper. The construction of the cantilevered rolls of the present invention are significantly shorter than conventional rolls . Accordingly the construction of the cantilevered rolls of the present invention do not require massive structural support and massive load bearing characteristics. Therefore, the apparatus of the present invention is significantly cheaper in capital costs.

The present invention comprises an apparatus and method for drawing, heat setting, quenching and crimping a massive tow.

In the broadest sense, the present invention comprises a process for the production of tow fibers composed of the steps of drawing, heat setting, and crimping at a nominal constant drawn denier per inch of the width of the tow.

In the broadest sense, the present invention comprises a process for drawing and heat setting a fiber bundle having a drawn density of greater than 150,000 denier per inch of width.

In the broadest sense, the present invention comprises stacker apparatus, drawing apparatus, and heat setting apparatus, each arranged such that a tow fiber bundle travels in succession from the stacker apparatus through the heat setting apparatus in a compacted form.

BRIEF DESCRIPTION OF THE DRAWINGS

Other objects and advantages of the present invention will become apparent upon reading the following detailed description and upon reference to the drawings, in which.

DESCRIPTION OF THE PREFERRED EMBODIMENTS

Figure 1:
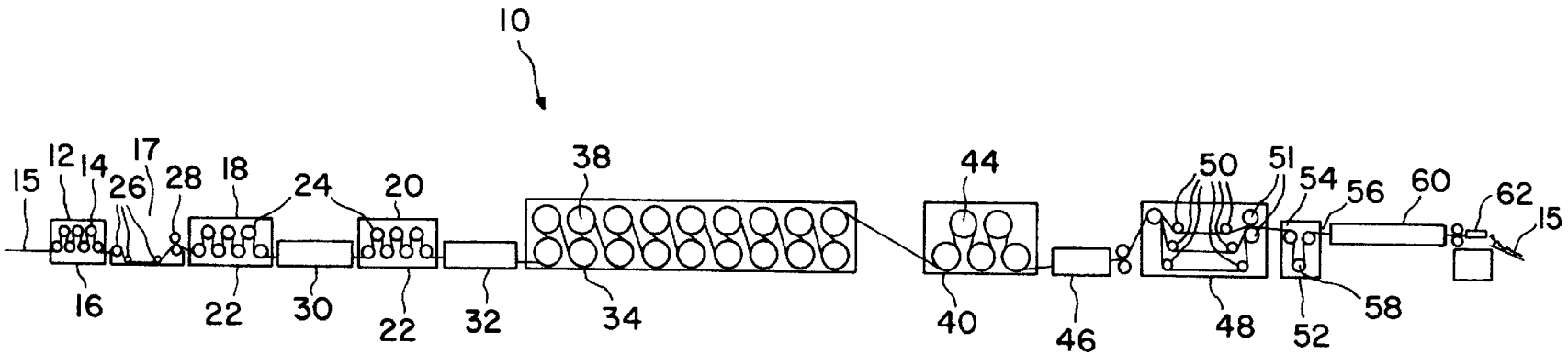
FIG. 1 illustrates a schematic diagram of a side view of a conventional draw line operation from drawing to crimping continuous filaments in the form of a tow.

Referring now to the accompanying drawings and initially to FIG. 1, a conventional PET processing line for drawing and heat setting filamentary tow, which the present invention seeks to improve, is depicted schematically and indicated generally by reference numeral 10. The processing line comprises a series of machine units arranged in alignment with one another for transport of a tow sequentially from one machine to the next.

Basically, tow 15 from storage cans or other suitable sources of tow supply (not shown) is initially delivered to a pretensioning-stand 12 having a series of driven cylindrical rolls 14 arranged alternatingly along upper and lower horizontal lines along the lengthwise extent of a central frame 16 for travel of the tow 15 in a serpentine path in engagement with the periphery of each upper and lower row in sequence, whereby the multiple rolls 14 collectively establish an initial tensioning point in the processing line 10 preliminary to downstream drawing of the tow 15.

Two drawstands 18, 20 are disposed at a downstream spacing from a vat 17 and from one another. Each drawstand 18, 20 similarly comprises a central upstanding frame 22 from which multiple cylindrical rolls 24 cantilevered outwardly extend alternatingly along upper and lower horizontal lines for travel of the tow 15 in a manner along a serpentine path peripherally about each roll 24 in sequence, whereby the two drawstands 18, 20 establish additional tensioning points along the processing line 10. A vat 17 containing a predrawing fluid, preferably a water-based emulsion, is disposed between the pretensioning-stand 12 and the drawstand 18, for application to the tow 15 before entering the first drawstand 18. The fluid aids in processing the tow e.g., reduced broken fils. A series of rolls 26 are mounted at the entrance of the vat 17 and also within the vat 17 below the fluid level to direct the travel of the tow 15 for immersion in the bath. At the end of the vat 17 are a pair of conventional nip rolls 28 to squeeze the excess fluid from the tow. A first fluid chest 30, basically constructed as an enclosed tunnel containing warm water sprays, is situated between the two drawstands 18, 20 to apply hot water to the tow 15. The hot water is sufficient to heat the tow approximately to its glass transition temperature. Another fluid chest 32 is disposed at the down stream side of the second drawstand 20 but operates at a higher temperature than the first fluid chest 30. Typically, the second fluid chest applies steam to the tow 15 while traveling through the interior of the chest, to heat the tow above its glass transition temperature.

A calender frame 34 is located immediately downstream of the second fluid chest 32 and basically comprises a relatively massive structure having a plurality of large-diameter rolls 38, cantilevered outwardly alternatingly along upper and lower horizontal lines for serpentine travel of the tow 15 peripherally about the rolls 38 in sequence, in like manner to that previously described with respect to the pretensioning stand 12 and the drawstands 18, 20. The cylindrical periphery of each calender roll 38, which is several times larger than the diameters of the rolls employed in drawstands 18, 20 or in the pretensioning stand 12, is heated from the interior by any suitable means, to a sufficient temperature (selected according to the physical characteristics of the tow 15, its traveling speed, residence time on the rolls, and other known variables) to heat-set the tow while it remains under tension. Due to the configuration of the rolls 38 in the calender frame 34, each side of the tow 15, which is in ribbon form, is heated to about 180–205° C. for typically polyethylene terephthalate fiber. Other polymers of course, have different $T_g$'s and require different heat setting ranges.

Immediately downstream of the calender frame 34, is a quench stand 40 having sequential cantilevered rolls 44 extending outwardly therefrom, to cool tow 15 sufficiently below the heat setting temperature thereby stabilizing the physical properties of the tow. From the quench stand 40, the tow progresses to spray stand 46 in which a spray (not shown) of suitable finishing composition is applied to the tow 15 to enhance subsequent crimping of the filaments of the tow.

The tow 15, still remaining in its ribbon-like form is too thin to process for conventional crimping apparatus. Accordingly, a stacker 48 positioned downstream from the finish spray stand 46 is employed to stack the tow so that it is both narrower and thicker. The stacker 48 comprises a plurality of rolls 50 arranged and shown in FIG. 1 to define separate travel paths by which the divided portions of the tow 15 can be directed to travel along independent paths. The rolls 50 define the different paths each being generally in converging relation with one another to direct the divided portions of the tow 15 to rolls 51 near the exit of the stacker 48 at which the divided portions of the tow 15 are reassembled atop one another to form a thicker narrower tow-band.

The tow 15 is delivered from the stacker 48 to a so-called dancer frame 52 which serves as a "slack" take-up device to provide constant tension to the downstream crimper. The dancer frame 52 has entrance and exit rolls 54, 56 between which a third roll 58 is vertically movable to take up tension fluctuations in the tow 15, to insure that the tow is delivered downstream to the crimper at substantially constant tension. Next, the tow 15 is transported from the dancer frame 52 through a steam atmosphere in a tunnel-like steam chest 60 to heat the tow to greater than its glass transition temperature, about 90° C. for drawn polyethylene terephthalate, to insure that the tow 15 will maintain its crimp nature when it runs through the crimper. From the steam chest 60 the tow is delivered to the crimper 62 which is conventionally known to impart crimp or texture to the tow. Crimper 62 may be a so-called stuffer box, a gear crimping unit, or other suitable alternative device well known in the industry. If staple filaments are desired, then downstream of the crimper 62 the tow 15 is typically dried and cut to staple lengths and collected in bale form for delivery to a conventional spinning operation for manufacture of spun yarn.

The draw line of FIG. 1 is typically for polyester fibers. Polyester fibers include homopolymers of polyethylene terephthalate, polybutylene terephthalate, polypropylene terephthalate, and polyethylene naphthalate. Polyester fibers also include copolymers based on polyethylene terephthalate, such as polyethylene terephthalate isophthalate, polyethylene terephthalate adipate, or polyethylene terephthalate succinate, etc.; or copolymers based on polybutylene terephthalate, such as polybutylene terephthalate adipate, polybutylene therephthalate succinate, etc.; or copolymers based on polypropylene terephthalate such as polypropylene terephthalate, adipate, or polypropylene terephthalate succinate, etc.; or copolymers based on polyethylene naphthalate, such as polyethylene naphthalate isaphthalate, polyethylene naphthalate adipate, polyethylene naphthalate succinate, or a mixture of any 2 or more of the above.

As described previously while the polyester processing line 10 represents an effective structure and methodology under the current state of the art for drawing, heat setting, and crimping of continuous synthetic filaments, the overall structure is quite massive and very expensive, due in a large part to the size required of the calender frame 34. The calender frame 34 must be quite massive as the tow exerts tons of force on each roll and the residence time must be sufficient to heat the tow sufficient to "lock-in" the physical properties, while the tow is still under tension. Heating the tow to its heat setting temperature imposes strict limitations on the traveling speed at which the tow 15 can be processed. Generally a residence time of approximately 5 seconds is required to heat a tow having a density of 75,000 denier/per inch of width. The massive structural requirements of the frame 34 and the bearing structures therein to support the rolls 38 against deflection, in order to satisfactorily apply heat uniformly throughout the entire tow 15 to both sides of the constituent filaments, can cost as much as ⅓ the cost of the entire line 10.

Fundamentally, the present invention substantially overcomes these difficulties and disadvantages and can run with a constant denier per inch of width far thicker (150,000 denier per inch of width of the tow or greater) than what is conventionally known with the apparatus of FIG. 1 (75,000 denier per inch of width of the tow prior to the stacker).

Figure 2:
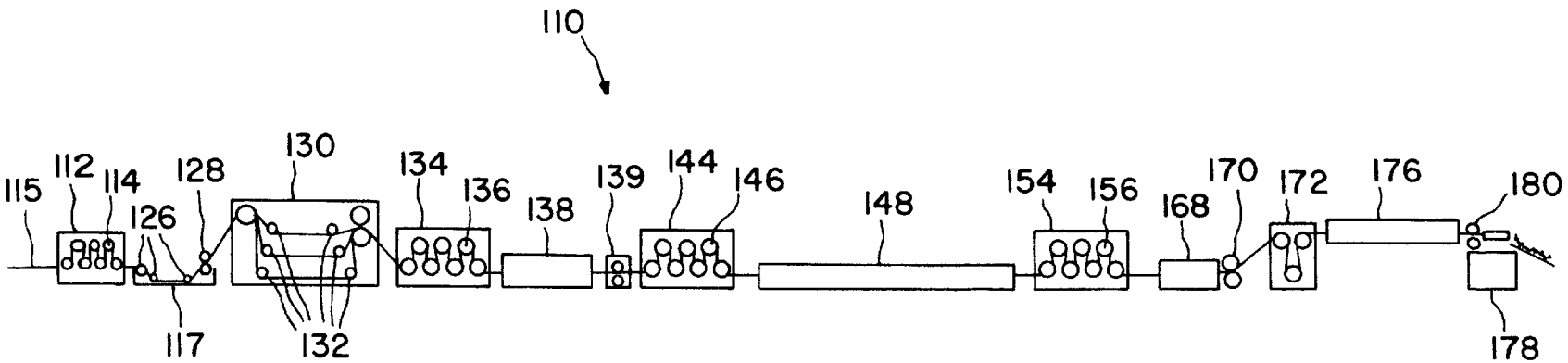
FIG. 2 illustrates a schematic diagram of a side view of the draw line operation of the present invention from drawing to crimping continuous filaments in the form of a tow.

With reference to FIG. 2, the present invention will be explained as follows. A synthetic fiber draw line of the present invention is generally indicated at 110. Generally, many small tows from a source such as tall containers arc gathered into a single tow typically 3 million denier or greater and enter the draw line 110 by means of the pretensioning device 112 having a series of rolls 114 which serve to place a slight amount of tension on the tow 115 so that all wrinkles, tangles, and bunched-up fibers are in a ribbon-like shape. This is accomplished by positioning the tow 115 around the rolls 114 in a serpentine path as is conventionally known in the art. Upon exit from the pretensioning device 112, the tow proceeds to a dip bath 117 which has a fiber lubricating fluid, which is generally water soluble, and serves to wet each individual filament so that as the tow is further processed, the filaments do not abrade one another. Rolls 126 guide the tow into the dip bath and provide a path for the tow to travel below the liquid level in the dip tank 117. At the end of the dip bath, are a pair of nip rolls 128 to squeeze the excessive fluid from the tow so that the excessive liquid does not wet the entire draw line 110.

At this stage tow 115 is in a flat ribbon-like shape and enters the stacker 130 having a plurality of rolls 132 designed to split the tow into several distinct segments and stack those segments vertically upon one another such that the tow is now in the shape of a thick ribbon about ½ (or less) as wide as what originally entered the stacker. From the stacker 130, the tow enters the first draw stage comprising first draw rolls, a spray bath and second rolls. The first drawstand 134 is comprised of the series of rolls 136. Next, the filament tow enters a spray bath 138 at an elevated temperature up to about 90° C. for PET. Although a spray bath is shown, any suitable heating means is acceptable, such as a heated liquid bath, a steam chest, electromagnetic radiation, etc. From the spray bath the tow enters the nip rolls 139 designed to remove excess moisture from the tow, and then enters the second drawstand 144 having a plurality of rolls 146. The rolls 146 have a circumferential velocity between 2 and 6 times faster than the circumferential velocity of the rolls 136 in the first drawstand 134. This differential in velocity causes the fibers to stretch 2 to 6 times their original length. The tow now enters the final draw and heat setting stage to further draw and orient the tow to a degree higher than can be achieved by the first draw stage, and to heat set the tow in the oriented condition while it is still under tension. Optionally, the final draw and heat setting can be accomplished in separate steps as is conventionally known. The final draw and heat set stage comprises drawstand 144, heating chamber 148, and drawstand 154. The rolls 156 on stand 154 are operated at about 1.1× to 2.5× times the speed of rolls 146 on the preceding stand 144 in order to impart the final, high tension orientation of the tow 115. At least part of this final stretch occurs in chamber 148 which is operated at an elevated temperature in the range from about 100° C. to about 200° C. or greater.

The drawing and heat setting stage operates at a tow density of 150,000 denier per inch of width of tow or more. This is considerably greater than the practice of the prior art. The high density allows all the rolls to be considerably shorter in length, reducing the bending loads on the rolls and drawstands. The reduced loadings allow the equipment to be of lighter and less expensive construction.

In order to heat the high-density tow, chamber 148 must employ one or more heating methods which allow the heat to penetrate to the interior of the tow, as opposed to heating only the surface and relying on simple conduction. Such penetrating heating methods include electromagnetic radiation such as microwave or infrared, heated liquid baths and sprays, and forced flow of hot gases through the tow. The heated liquid bath may comprise heated oil, such as mineral oil, or any liquid which does not evaporate at a temperature below about 200° C. Particularly suitable are methods which employ condensation of saturated vapor onto the tow, and especially condensation from pressurized vapors. The pressure provides a means for penetration of the vapors to the interior of the porous tow.

At the high temperatures of chamber 148, crystallization of the polymer occurs while it is still under the high tensions of the final draw stage. This provides a means for "locking in" the oriented structure of the fibers, to provide desirable properties of high modulus and low shrinkage in the final product. After the tow is heat set in chamber 148 it passes onto the unheated rolls 156 of drawstand 154 for quenching the tow. The tow temperature is decreased to a point below the glass transition temperature of the polymer before the tension is released, so that the highly oriented structure is retained.

From the draw stand 154 the tow enters the finishing chamber 168 having rolls 170 in which a liquid coating is applied to the tow for ease of processing, or to apply a surface treatment to the tow filaments to yield particular characteristics. Conventional finishes are well known in the industry. After the finish chamber, the tow enters into a steam chest 176 by first traversing through a take-up roll stand 172 having similar to dancer frame 52 of FIG. 1. The steam chest 176 quickly elevates the temperature of the tow for the same purpose as steam chest 60 in FIG. 1. The tow enters the crimper 178 by means of a pair of conventional nip rolls 180. The crimper 178 can be the stuffer box type or any conventional equipment capable of handling a tow of at least 150,000 denier per inch. Such apparatus is well known.

In operation, a tow of at least 3 million denier, collected from several spinning sources, or from a plurality of tow cans (not shown) enter a pretensioning device 112 having rolls 114 designed to straighten the individual filaments making up the ribbon-like shaped tow. Upon exit from the pretensioning device 112, the tow 115 enters the dip bath designed to supply a bit of moisture to the tow thus making it more processable (reducing the fiber to fiber abrasion). Typically, the dip bath applies an aqueous solution or solvent, at approximately ambient temperature (room temperature in most cases). The tow then enters the stacker 130 where the tow is plied upon one another to create an overall tow about ½ (or less) as wide and about 3 times thicker. After the stacker, the tow 115 enters the first drawstrand in which the rolls 136 typically have a circumferential velocity in the range of 50 mpm (meters per minute) to 200 mpm. The spray bath 138 serves to heat the tow to at least above the first glass transition temperature of the polyester (which for amorphous polyethylene terephthalate is approximately 70° C.). The tow then enters the second draw frame 144 and follows a serpentine path whereby the rolls of the second draw frame rotate at a circumferential velocity between the range of 100 mpm and 400 mpm. Because of the difference in rotational speeds, and heating the fiber in the spray bath 138, the tow draws between 2.0 and 4.0 times its original length in the spray bath 138. For polyester type polymeric fibers the total draw ratio is generally between 2 and 6 times its original length. For other polymeric fibers the total draw may be between 2 and 10 times its original length, depending on the type of polymer.

After the first draw, the tow is typically drawn again to further increase the physical properties. The drawing must occur at an elevated temperature, and this is provided in heating chamber 148. In prior practice, it has been common to separate the final drawing and the heat setting stages, with the heat setting typically accomplished on heated rolls following the draw zone. In the present invention, it is preferred to combine the final drawing and the heat setting in one device. This simplifies the equipment, and also ensures that heat setting occurs at maximum orientation. After heat setting it is important not to allow the tension to relax until the temperature is reduced to about the glass transition temperature or below of the polymeric fiber or else some of the orientation could be lost. It is the function of drawstand 154 not only to provide motive power for the final stretching of the towband, but also to provide for cooling of the tow after it exits from heated chamber 148 before tension is released. For this purpose, the rolls 156 may be provided with means for cooling such as internal circulation of cooling water or external fans which blow air over the tow.

After quenching, the tow is conventionally treated to a finish composition, heated sufficient to introduce the tow to a crimper, and crimped to provide the tow with "bulking" characteristics as is conventionally known. The tow then may be wound by winders (not shown) on a spindle (also not shown) and sold, or the tow exiting the crimper may be cut into staple lengths by conventional equipment (not shown) well known to those skilled in the art and baled and sold as staple fibers.

Thus it is apparent that there has been provided in accordance with the invention, a process that fully satisfies the objects, aims, and advantages set forth above. While the invention has been described in conjunction with specific embodiments thereof it is evident that many alternatives, modifications, and variations will be apparent to those skilled in the art in light of the foregoing description. Accordingly as intended to embrace all such alternatives, modifications, and variations as are within the spirit and scope of the invention.

What is claimed is:

1. A process for the production of polymeric fibers in the form of a tow, comprising: drawing a tow, which has a denier of at least about 3 million before being drawn, between 2 and 10 times it original length, heat setting said tow under tension, and crimping said tow to provide bulking, whereby said tow, after drawing, has a constant denier per inch of width.

2. The process of claim 1, wherein said ton, after drawing has a denier per inch of width of 150,000 or more.

3. A process according to claim 1, which comprises drawing the tow between 2 and 6 times its original length.

4. The process of claim 3, wherein said polymeric fiber is selected from the group consisting of homopolymers and copolymers of polyethylene terephthalate; homopolymers and copolymer of polypropylene terephthalate; homopolymers and copolymers of polybutylene terephthalate; and homopolymers and copolymers of polyethylene naphthalate.

5. The process of claim 1, wherein said heat setting is carried out using pressurized gas which condenses on the tow, electromagnetic radiation, or a heated liquid bath.

6. The process of claim 5, wherein said electromagnetic radiation is infrared radiation or microwave radiation.

7. The process of claim 5, wherein said heated liquid bath comprises heated oil or any liquid which does not evaporate at a temperature below about 200° C.

8. The process of claim 7, wherein said heated oil is mineral oil.

9. The process of claim 5, wherein said pressurized gas is steam which condenses on the tow.

10. The process of claim 1, wherein said tow is quenched after said heat setting step.

11. A process for the production of polymeric fibers in the form of a tow, comprising: drawing a tow, which has a denier of at least about 3 million before being drawn, between 2 and 10 times its original length and heat setting said tow under tension, whereby said tow, after drawing, has a denier per inch of width of 150,000 or more.

12. A process according to claim 1, which comprises drawing the tow between 2 and 6 times its original length.

13. The process of claim 12, wherein said polymeric fiber is selected from a group consisting of homopolymers and copolymers of polyethylene terephthalate; homopolymers and copolymer of polypropylene terephthalate; homopolymers and copolymers of polybutylene terephthalate; and homopolymers and copolymers of polyethylene naphthalate.

14. The process of claim 11, wherein said heat setting is carried out using pressurized gas which condenses on the tow, electromagnetic radiation, or a heated liquid bath.

15. The process of claim 14, wherein said electromagnetic radiation is infrared radiation or microwave radiation.

16. The process of claim 14, wherein said heated liquid bath comprises heated oil or any liquid which does not evaporate at a temperature below about 200° C.

17. The process of claim 14, wherein said pressurized gas is steam which condenses on the tow.

18. A process according to claim 3, wherein the tow, after drawing, has a denier per inch of width of 150,000 or more.

19. A process according to claim 3 wherein the drawn tow has a denier of 1.0 million or greater.

20. A process according to claim 19, wherein the tow has a constant drawn denier per inch of width of 150,000 or greater during heat setting and crimping.

21. A process according to claim 20, which further comprises the step, prior to drawing, of splitting the tow into several distinct segments and stacking the segments vertically upon one another, such that the tow is one third or less its original width.

22. A process according to claim 20, wherein the drawing is carried out in two stages and the heat setting is effected in a heating chamber and wherein at least part of the final drawing is effected in said heating chamber.

23. A process according to claim 20, wherein the polymeric fibers are polyester.

24. A process according to claim 1, wherein the tow has a constant drawn denier per inch of width of 150,000 or greater during heat setting and crimping.

25. A process according to claim 1, which further comprises the step, prior to drawing, of splitting the tow into several distinct segments and stacking the segments vertically upon one another, such that the tow is one third or less its original width.

26. A process according to claim 1, wherein the drawing is carried out in two stages and the heat setting is effected in a heating chamber and wherein at least part of the final drawing is effected in said heating chamber.

27. A process according to claim 11 wherein the drawn tow has a denier of 1.0 million or greater.

28. A process according to claim 27, wherein the tow has a constant drawn denier per inch of width of 150,000 or greater during heat setting and crimping.

29. A process according to claim 27, which further comprises the step, prior to drawing, of splitting the tow into several distinct segments and stacking the segments vertically upon one another, such that the tow is one third or less its original width.

30. A process according to claim 27, wherein the drawing is carried out in two stages and the heat setting is effected in a heating chamber and wherein at least part of the final drawing is effected in said heating chamber.

31. A process for drawing, heat setting and crimping filaments of synthetic polymeric material in the form of a tow, which comprises drawing the tow under tension to orient the molecular structure of each filament of the tow, heat setting the tow in the oriented condition while it is still under tension and thereafter crimping the tow, wherein the drawn tow has a denier of 1.0 million or greater and a constant drawn denier per inch of width of 150,000 or greater during heat setting and crimping.

32. A process according to claim 31, which further comprises cooling the tow after heat setting and before the tension is released.

33. A process according to claim 31, wherein the tow has a denier of at least about 3 million before being drawn.

34. A process for the production of polymeric fibers in the form of a tow, comprising: drawing said tow between 2 and 10 times its original length and heat setting said tow under tension using pressurized gas which condenses on the tow, electromagnetic radiation, or a heated liquid bath, whereby said tow, after drawing, has a denier per inch of width of 150,000 or more.

35. The process of claim 34, wherein said electromagnetic radiation is infrared radiation or microwave radiation.

36. The process of claim 34, wherein said heated liquid bath comprises heated oil or any liquid which does not evaporate at a temperature below about 200° C.

37. The process of claim 34, wherein said pressurized gas is steam which condenses on the tow.

38. The process of claim 34, which comprises drawing the tow between 2 and 6 times its original length.

* * * * *